US007267582B2

(12) United States Patent
Schaich

(10) Patent No.: US 7,267,582 B2
(45) Date of Patent: Sep. 11, 2007

(54) PLUG-AND-SOCKET CONNECTION HAVING ADDITIONAL CONTACT DEVICE, PARTICULARLY FOR DATA TRANSMISSION

(75) Inventor: Udo Schaich, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/483,021

(22) PCT Filed: Jan. 27, 2003

(86) PCT No.: PCT/DE03/00214

§ 371 (c)(1),
(2), (4) Date: Jun. 22, 2004

(87) PCT Pub. No.: WO03/094299

PCT Pub. Date: Nov. 13, 2003

(65) Prior Publication Data

US 2004/0235333 A1 Nov. 25, 2004

(30) Foreign Application Priority Data

May 4, 2002 (DE) ..... 202 07 091 U

(51) Int. Cl.
*H01R 24/00* (2006.01)
*H01R 33/00* (2006.01)

(52) U.S. Cl. ..... 439/660; 439/924.1

(58) Field of Classification Search ..... 439/680, 439/681, 378, 660, 924.1, 374
See application file for complete search history.

(56) References Cited

U.S. PATENT DOCUMENTS

| | | | | |
|---|---|---|---|---|
| 4,736,999 | A | 4/1988 | Marks et al. | 439/314 |
| 5,356,300 | A * | 10/1994 | Costello et al. | 439/101 |
| 2003/0085108 | A1 * | 5/2003 | Chiang et al. | 200/51.09 |

FOREIGN PATENT DOCUMENTS

| | | |
|---|---|---|
| EP | 0 418 782 | 3/1991 |

* cited by examiner

*Primary Examiner*—Javaid H. Nasri
(74) *Attorney, Agent, or Firm*—Kenyon & Kenyon LLP

(57) ABSTRACT

A plug-and-socket connection including a plug and a mating connector, the plug and the mating connector in each case having a housing in which contact elements are provided for producing the electrical plug-and-socket connection and for conducting high currents and voltages, and guide elements being provided in each case on the housing for the exact guidance of the plug. According to the present invention, the guide elements are formed as electrical contact elements. The contact elements used here are utilized, for example, to transmit data streams as currents in the low-voltage range.

6 Claims, 4 Drawing Sheets

Fig.10
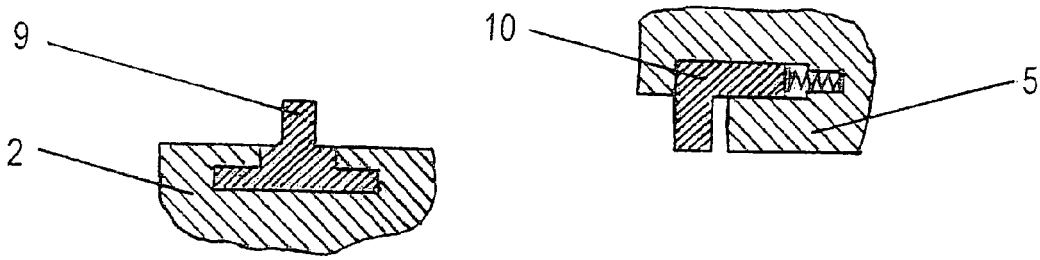
Fig.11
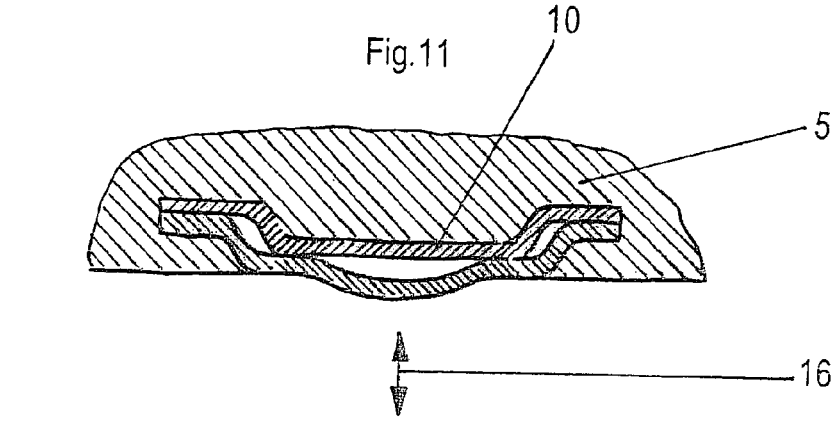
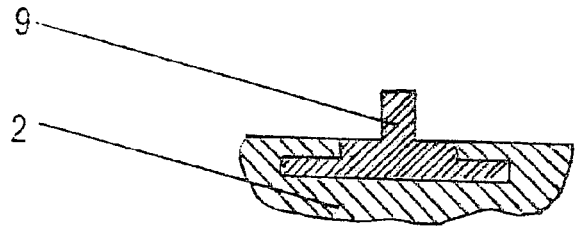
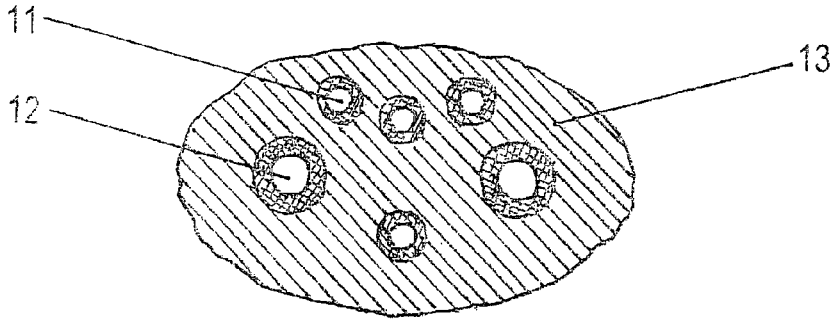
Fig.12

PLUG-AND-SOCKET CONNECTION HAVING ADDITIONAL CONTACT DEVICE, PARTICULARLY FOR DATA TRANSMISSION

FIELD OF THE INVENTION

The present invention relates to a plug-and-socket connection including a plug and a mating connector. Each of the plug and the mating connector has a housing in which contact elements are provided for producing an electrical connection and for conducting high currents and voltages, and guide elements on the housing which are formed to exactly guide the plug into the mating connector.

BACKGROUND INFORMATION

To produce an electrical plug-and-socket connection, a plug and a corresponding mating connector are needed, one of the two plug-in devices having contact elements that are insertable into socket-like openings in the mating connector. Generally, the above plug-and-socket connections are used to transmit currents or voltages.

Particularly in motor-vehicle technology, provision is made to form the so-called blade part of the plug in such a way that the contacts of the blade part are surrounded by a housing, into which the socket part of the mating connector is able to be inserted. To ensure a suitable provided polarity or allocation of the contact elements to the mating connectors, guide elements are provided both on the plug and on the mating connector which allow insertion exclusively in a defined direction. If the plug is inserted into the mating connector in a different direction, it is not possible to produce a contact.

One preferred design of these guide elements is that noses are provided on a plug part which engage in openings on sides of the mating connector. These noses are preferably arranged directly in the housing of the plug or mating connector, and are designed as a one-piece part.

Plug-and-socket connections of the aforesaid type are used in particular for transmitting currents and voltages. They are designed in such a way that they are rated either for high currents, high voltages (high-voltage range), for normal currents, normal voltages, or for low currents, low voltages (low-voltage range). High voltages lie in the range of approximately 200 V and peak currents up to approximately 50 A. Small voltages lie in the range between 5 and 12 V, and are particularly suitable for the power supply or driving of, for example, processors, RAM, EPROM, etc.

Particularly in the motor-vehicle sector, it is necessary, first of all, to transmit control currents which are provided to ensure the functions of the individual devices. Generally, they are in the high-voltage range. On the other hand, it is necessary to transmit currents, particularly in the low-voltage range, which are provided for transmitting measurement data made available by probes, for instance, in the engine compartment, to an engine-management control unit. Therefore, it is necessary to create plug-and-socket connections for various voltages or currents, so that a plurality of plug-and-socket connections are necessary.

SUMMARY

An object of the present invention is to reduce the number of plug-and-socket connections.

In accordance with one advantegeous embodiment of the present invention, in a very simple manner without special remodeling of the plug-and-socket connections, both voltages and currents in the high range are able to be coupled with voltages and currents in the low range using a single electrical plug-and-socket connection.

To that end, the guide elements, which are necessary for inserting a plug into a mating connector in a manner restricted as to direction, are advantageously constructed as contact elements. In particular, detents and locking grooves thus have contact elements which are brought together via suitable electric lines, preferably with the main sheathing of the remaining cables, that are connected to the wide contact elements.

Special constructions of the contact elements are to be seen in that they are designed to be flexible and thus produce an electrical connection which is functional at any time. Various forms of the suitable contact bars for the low-voltage range are provided and are used to adapt to the different conditions.

The contact elements may be inserted in a simple manner into die molds and have serrated edges which make it possible for the extruded plastic to join with the corresponding contact elements with form and friction locking.

BRIEF DESCRIPTION OF THE DRAWINGS

FIG. 10 shows a schematic view of a combination of a rigid contact bar with a flexible contact bar formed with an L-shaped cross-section (socket part-blade part).

FIG. 11 shows a schematic view of a contact bar formed as a combination of a contact bar with flexible contact elements (socket part-blade part).

FIG. 12 shows a schematic representation of a cross-section of a cable routing to one of the plugs according to an example embodiment of the present invention.

DETAILED DESCRIPTION OF EXAMPLE EMBODIMENTS

Figure 1:
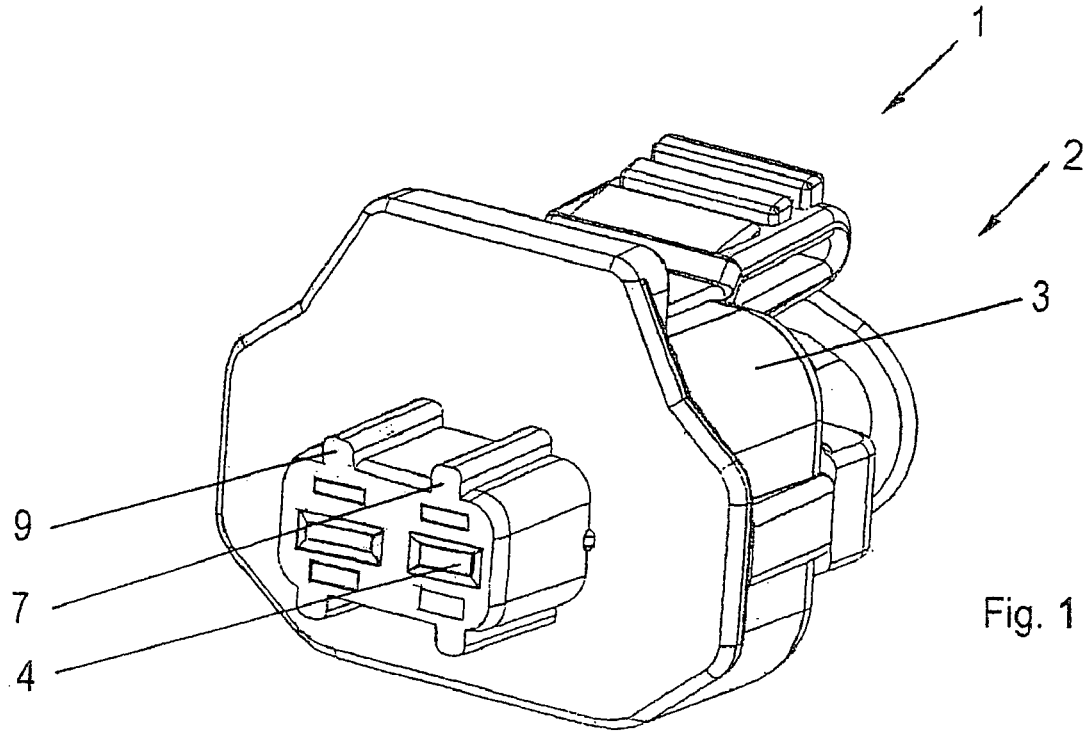
FIG. 1 shows a perspective view of a plug having contact bars according to an example embodiment of the present invention (socket part).
Figure 2:
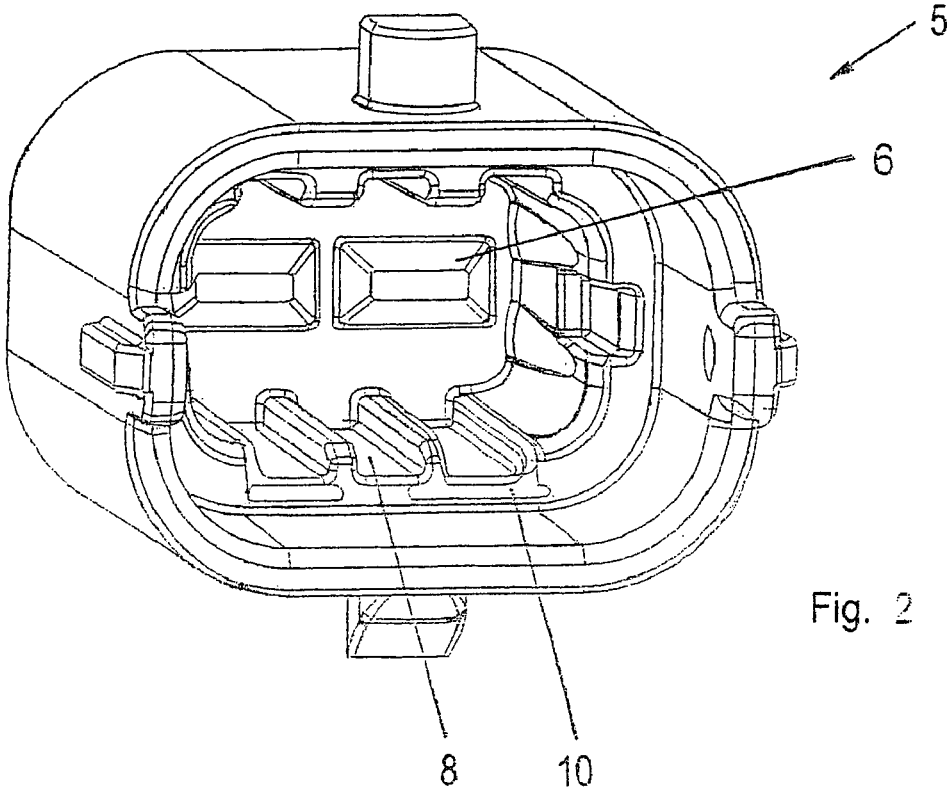
FIG. 2 shows a perspective view of contact bars of a mating connector shown with a broken line (blade part).

FIG. 1 shows socket part 2 of an electrical plug-and-socket connection 1. Socket part 2 includes a housing 3 and contact elements 4, arranged in housing 3, which are provided for receiving contacts 6 depicted in a blade part 5 in FIG. 2. Also provided in the area of socket part 2 on housing 3 are guide elements 7 which are insertable into recesses 8 as are shown in FIG. 2 in blade part 5.

According to an example embodiment of the present invention, at least a part of guide elements 7 are formed as contact bars 9 which, in the joined state, i.e., after producing the electrical plug-and-socket connection, then co-operate with contact bars 10 in the region of mating connector 5.

In this context, provision is made to use contact elements 4 and contacts 6 for the high-voltage range, and to use contact bars 9 of the present invention of socket part 2 and contact bars 10 of blade part 5 to transmit suitable currents in the low-voltage range.

As shown in FIG. 12, it is preferably provided to combine electric cables 11, which are allocated to the low-voltage range, with shielded cables 12 for the high-voltage range, and to provide them with a main sheathing 13.

Varied embodiments, as are provided in FIGS. 3 through 11, may be designed for the formation of contact bars 9 of socket part 2, and of contact bars 10 of blade part 5.

Figure 3:
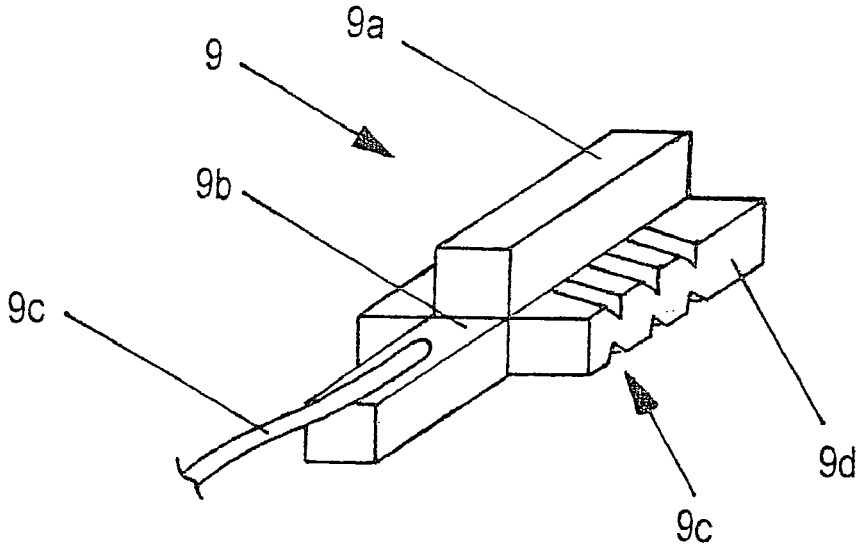
FIG. 3 shows a perspective view of an exemplary embodiment of a possible form of a contact bar.
Figure 4:
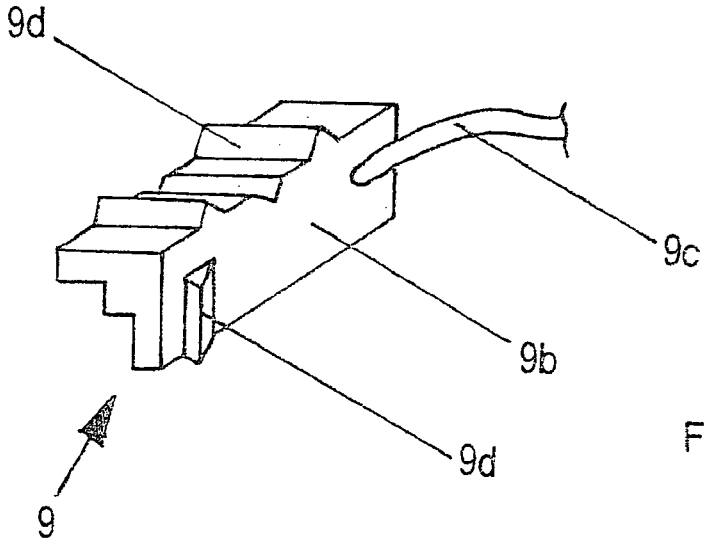
FIG. 4 shows a perspective view of a further exemplary embodiment of a contact bar.

FIGS. 3 and 4 show such contact bars 9 for the designs on a socket part 2. They are made up of a contact area 9*a*, a contact plane 9*b* that is connected to an electric cable 9*c*, as well as a region provided for retaining contact bar 9 within the plastic. For this purpose, in each case a specific embodiment of a serrated edge 9*d* is shown in FIGS. 3 and 4.

FIG. 4 shows a contact bar 9 having an L-shaped cross-section. It likewise has a contact plane 9*b* that is connected to an electric cable 9*c*. Moreover, two regions are provided that are designed with suitable serrated edges 9*d*.

Figure 5:
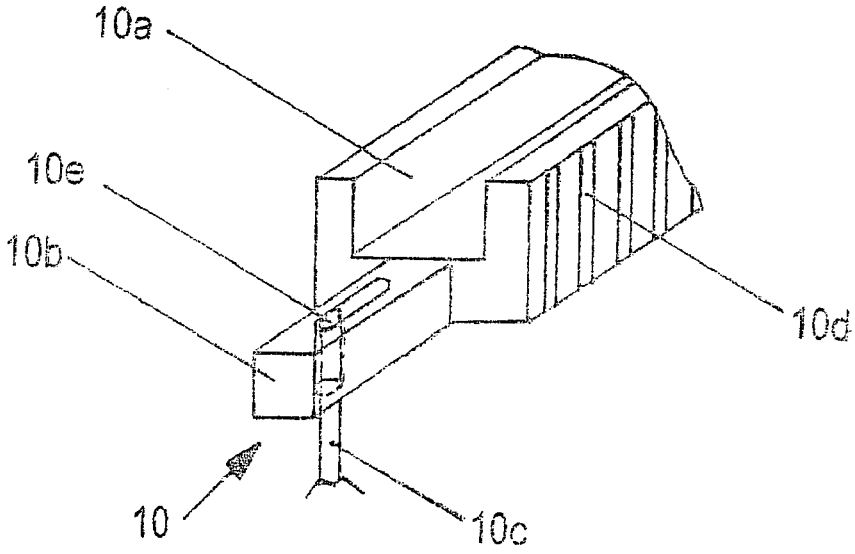
FIG. 5 shows a perspective view of a third exemplary embodiment of a contact bar.

FIG. 5 shows a third exemplary embodiment of a contact bar 10, having a U-shaped cross-section, for a blade part 5. This contact bar 10 has a contact area 10*a* and is additionally provided with a contact plane 10*b* that is connected to an electric cable 10*c*. Electric cable 10*c* is run via a bore hole 10*e* onto contact plane 9*b*.

Additionally provided on the lateral wall of contact bar 10, having a U-shaped cross-section, is a serrated edge 10*d* in the form of a surface, the surface itself having a suitable ribbing.

In the exemplary embodiments shown in FIG. 3 through 5, electric cables 9*c*/10*c* are either cemented, welded or soldered to contact plane 9*b*/10*b*.

FIG. 6 through FIG. 11 show different example embodiments of contact bars 9 of the present invention for socket parts 2 and contact bars 10 for blade parts 5.

Figure 6:
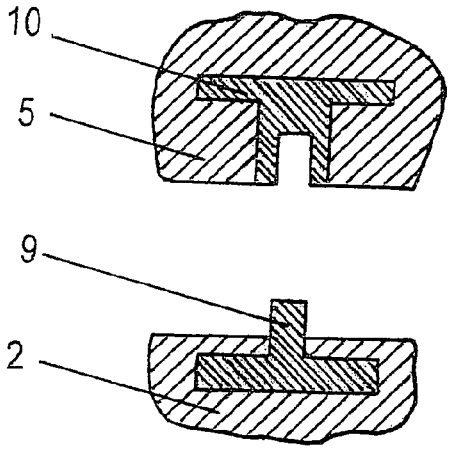
FIG. 6 shows a schematic representation of a rigid form of a contact bar (socket part and blade part).

In FIG. 6, contact bars 9/10 are rigid. Both have a T-shaped cross-section and are firmly embedded in housing 3 of socket part 2 and of blade part 5.

Figure 7:
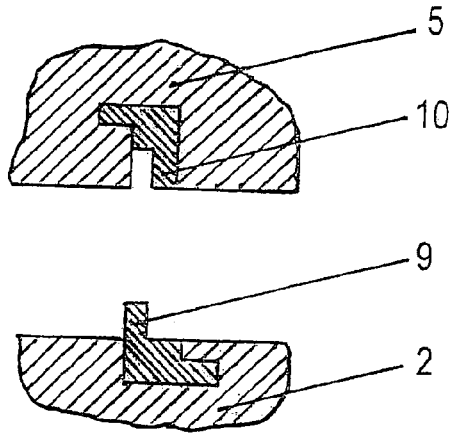
FIG. 7 shows a schematic view of a contact bar having an L-shaped cross-section (socket part-blade part).

In a further exemplary embodiment shown in FIG. 7, contact bar 9 of socket part 2 has an L-shaped cross-section, and cooperates accordingly with a contact bar of a blade part 5.

Figure 8:
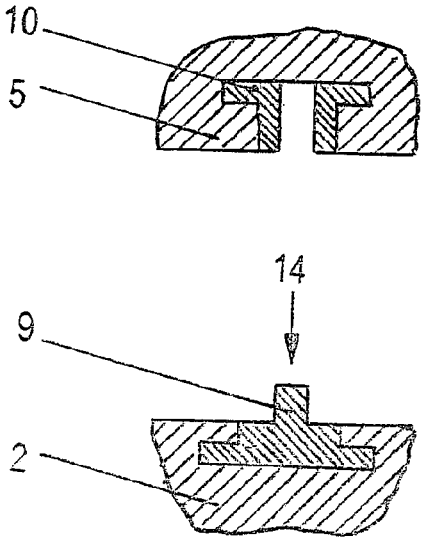
FIG. 8 shows a schematic view of a contact bar formed as a bar (socket part-blade part).

Another example embodiment of a form of a contact bar 9/10 is shown in FIG. 8. Contact bar 9 situated in socket part 2 has a pin-like formation 14 that is surrounded by cheek-like formations of contact bar 10 of blade part 5, and thus, in this manner, produces an electrical contacting.

Figure 9:
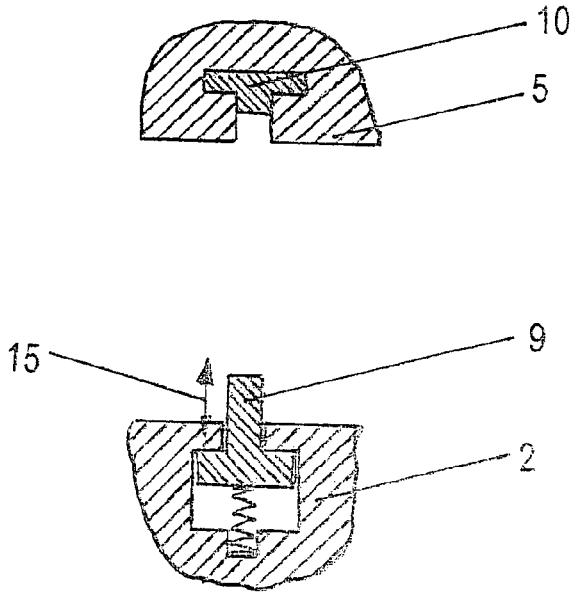
FIG. 9 shows a schematic view of a contact bar formed as a flexible bar or strip (socket part-blade part).

In FIG. 9, contact bar 9 of socket part 2 is flexibly inserted and is designed to be movable in the direction of an arrow or its counter-arrow 15. This has the advantage that, in spite of possibly occurring thermal differences which lead to different expansions between the plug and mating connector, an electrical connection to contact bars 10 in blade part 5 always remains.

A reverse design is shown in FIG. 10. In this case, contact bar 10 is flexibly supported in blade part 5.

A further alternative design for the flexible support is shown in FIG. 11. Contact bar 10 is inserted in a preloaded manner into blade part 5 and has a hollow space toward blade part 5. Because of this hollow space, contact bar 10 is movable in the direction of an arrow 16 or its counter-arrow.

Various specific embodiments are provided for the formation of the contact bars, and all have the advantage that additional plug-and-socket connections are avoided, which are needed particularly for connections in the low-voltage range, and all are easily able to be combined with plugs already previously placed.

What is claimed is:

1. A plug-and-socket connection, comprising:

a plug and a mating connector, each of the plug and the mating connector having a respective housing in which contact elements are provided for producing an electrical plug-and-socket connection and for conducting high currents and voltages, guide elements being provided on each of the housings for guidance of the plug, wherein the guide elements include electrical contact elements, and wherein at least a part of a pair of the guide elements that does not include the electrical contact elements is designed to be flexible.

2. The plug-and-socket connection as recited in claim 1, wherein the guide elements are formed as detents and locking grooves.

3. The plug-and-socket connection according to claim 2, wherein the detents are formed on the socket and the locking grooves are formed in the plug.

4. A plug-and-socket connection, comprising:

a plug and a mating connector, each of the plug and the mating connector having a respective housing in which contact elements are provided for producing an electrical plug-and-socket connection and for conducting high currents and voltages, guide elements being provided on each of the housings for guidance of the plug, wherein the guide elements conduct small currents and voltages, a ratio of the high voltages and current to the small current and voltages being approximately at least 10, wherein at least a part of a pair of guide elements that does not include electrical contact elements is flexible.

5. The plug-and-socket connection as recited in claim 4, wherein the guide elements are formed as detents and locking grooves.

6. The plug-and-socket connection according to claim 5, wherein the detents are formed on the socket and the locking grooves are formed in the plug.

* * * * *